US007318400B2

(12) United States Patent
Lipke et al.

(10) Patent No.: US 7,318,400 B2
(45) Date of Patent: Jan. 15, 2008

(54) LOCKING PIN MECHANISM FOR A VANE-TYPE CAM PHASER

(75) Inventors: Thomas L. Lipke, Rochester, NY (US); Jason M. Urckfitz, Brockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 93 days.

(21) Appl. No.: 11/229,940

(22) Filed: Sep. 19, 2005

(65) Prior Publication Data

US 2007/0062474 A1 Mar. 22, 2007

Related U.S. Application Data

(63) Continuation of application No. 10/788,983, filed on Feb. 27, 2004, now Pat. No. 6,948,467.

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 5,960,757 A 10/1999 Ushida
6,516,763 B1 2/2003 Strauss
2003/0084863 A1* 5/2003 Golovatai-Schmidt et al. ..... 123/90.17

FOREIGN PATENT DOCUMENTS

JP 2001041012 2/2001

* cited by examiner

*Primary Examiner*—Zelalem Eshete
(74) *Attorney, Agent, or Firm*—Paul L. Marshall

(57) ABSTRACT

A rotor-locking mechanism for a vane-type camshaft phaser. A locking pin is disposed in the rotor and is permitted to travel into a well in either the rear cover or the front cover of the phaser. The pin is urged into the well by a return spring, and the end of the pin end is exposed to oil pressure for unlocking the pin. A first channel is provided between the advance-oil feed and the end of the pin, and a second channel is provided between the retard-oil feed and the end of the pin. The channels may be formed in either of the covers. The pin is unlocked whenever a predetermined oil pressure is exceeded in either the advance or retard oil feeds, permitting the pin to be unlocked through most modes of engine operation and to be locked only under specific predetermined low-pressure conditions, such as during engine starting.

16 Claims, 7 Drawing Sheets

LOCKING PIN MECHANISM FOR A VANE-TYPE CAM PHASER

This application is a continuation of U.S. application Ser. No. 10/788,983, filed on Feb. 27, 2004, which issued as U.S. Pat. No. 6,948,467 on Sep. 27, 2005.

TECHNICAL FIELD

The present invention relates to vane-type camshaft phasers for varying the phase relationship between crankshafts and camshafts in internal combustion engines; more particularly, to such phasers wherein a locking pin assembly is utilized to lock the phaser rotor with respect to the stator at certain times in the operating cycle; and most particularly, to an improved locking pin mechanism having pin release means for actuation in both the advance and retard phaser modes.

BACKGROUND OF THE INVENTION

Camshaft phasers for varying the phase relationship between the crankshaft and a camshaft of an internal combustion engine are well known. In a typical vane-type cam phaser, a controllably variable locking pin is slidingly disposed in a bore in a rotor vane to permit rotational locking of the rotor to the stator under certain conditions of operation of the phaser and engine. A known locking pin mechanism includes a return spring to urge an end of the pin into a hardened seat disposed in the pulley or sprocket (pulley/sprocket) of the phaser, thus locking the rotor with respect to the stator. The rotor may be formed of aluminum, and a steel bushing is pressed and staked into the bore at a predetermined axial location to guide the pin. In a prior art embodiment, the pin is shouldered, which shoulder engages the rotor bushing as a limit stop to pin travel. In operation, the pin is forced from the bushing and well in the pulley/sprocket to unlock the rotor from the stator by pressurized oil supplied from a control valve, overcoming the seating spring, in response to a programmed engine control module (ECM). The oil may be applied to the end of the pin and/or to the underside of the shoulder via passages formed in the rotor and/or the pulley/sprocket.

A prior art phaser has several shortcomings that are overcome by an improved phaser in accordance with the invention.

First, the pin and the seat typically include mating annular bevels to center the pin in the seat and thereby minimize angular lash between the rotor and the sprocket while locked. If the pin is permitted to engage the seat fully, however, the pin may become jammed into the seat and not respond reliably to opening oil pressure, so the shoulder is provided on the prior art pin to limit travel thereof. It is known that, with repeated use, the pin shoulder can displace the rotor bushing axially, resulting in failure of the phaser. Therefore, means are needed to eliminate the need for a pin shoulder.

Second, to permit rotation of the rotor, the pin is retracted by pressurized oil flowing from the adjacent advance chamber via a channel in the sprocket face. However, in some instances the pressure build-up in the advance chamber is rapid enough and large enough that the pin becomes bound in the well before there is sufficient pressure to cause it to withdraw, thus causing the phaser to be unable to alter the valve phase as demanded. Therefore, means are needed to ensure that the pin will not be stuck in the locked position when rotor rotation is required.

Third, the prior art mechanism includes the locking pin and return spring in a blind bore in the rotor facing against the pulley/sprocket. This mechanism can be difficult to assemble reliably. Therefore, a simpler, easier means is needed for providing a locking mechanism in a vane-type cam phaser.

It is a principal object of the present invention to improve the reliability of unlocking of a cam phaser locking mechanism.

SUMMARY OF THE INVENTION

Briefly described, in a rotor-locking mechanism for a vane-type camshaft phaser in accordance with the invention, the locking pin is a straight-sided pin disposed in the rotor. The prior art pin shoulder is omitted, permitting the pin to travel without restraint into a well in either the pulley/sprocket ("rear cover") or the outer cover plate ("front cover"). The pin is urged conventionally into the well by a return spring. The end portion of the pin end is exposed to oil pressure for unlocking the pin when it is fully seated. A first oil channel is provided between the advance-oil feed, which may include an advance chamber, and the end portion of the pin. In addition, a second oil channel is provided between the retard-oil feed, which may include a retard chamber, and the end portion of the pin. The channels may be formed in either of the covers or in the rotor itself. Thus, the pin is unlocked whenever a predetermined oil pressure is exceeded in either the advance or retard oil feeds. This permits the pin to remain unlocked through most modes of engine operation and to be locked only under specific predetermined low-pressure conditions, such as engine starting.

In a currently preferred embodiment, the locking well is provided in the front cover of a phaser such that the locking pin, spring, and spring guide may be assembled into the rotor after the rotor is installed into the stator. Therefore, the channels are formed in the front cover.

A principal benefit of the invention is that the rotor is free to respond instantaneously to positional demands from the engine control module in most modes without having to sequence correctly with a pin-unlocking step.

A secondary benefit is that the locking mechanism may be easily and reliably installed into the phaser during assembly thereof.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
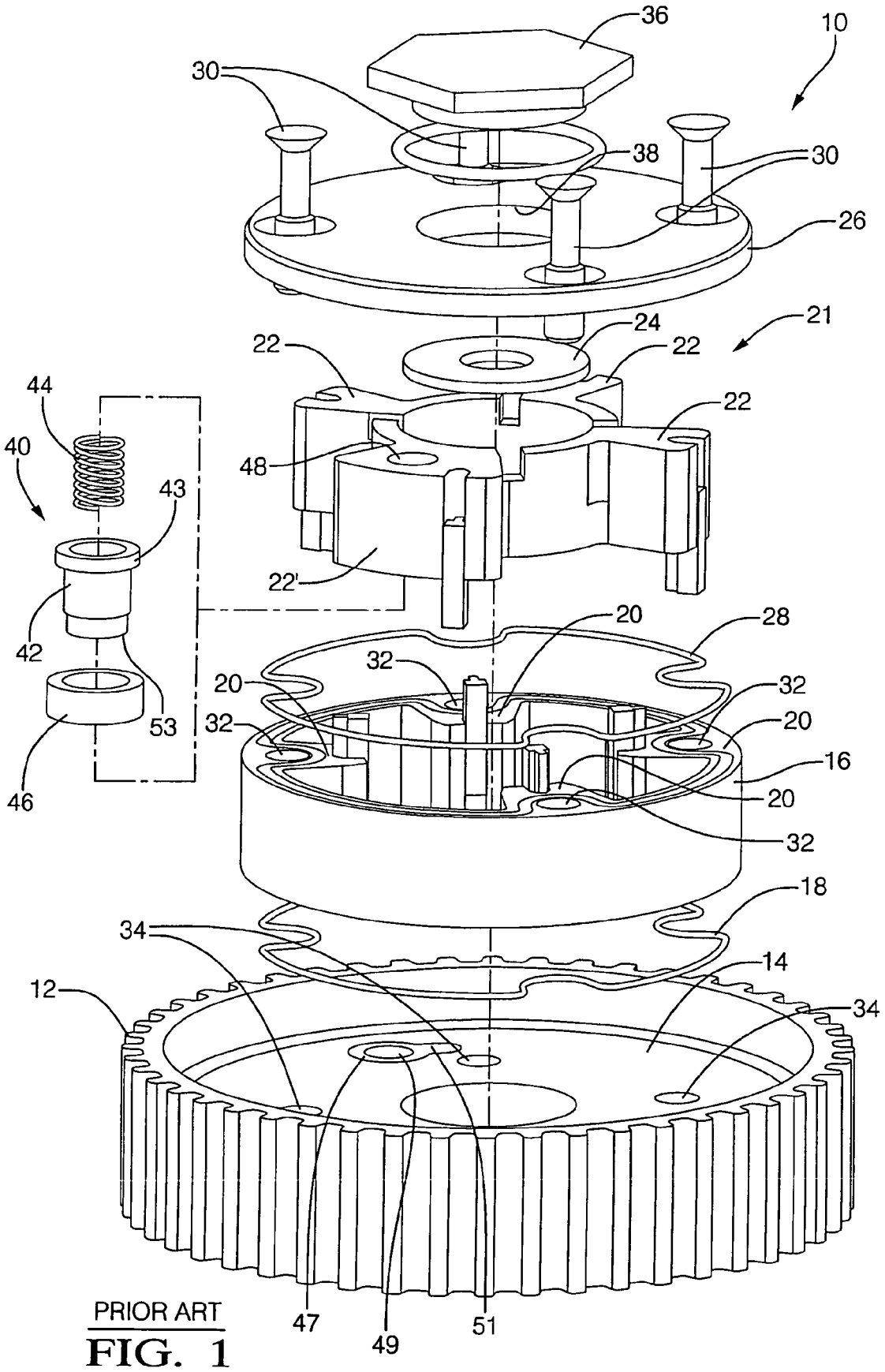
PRIOR ART FIG. 1
FIG. 1 is an exploded isometric view of a typical prior art vane-type camshaft phaser.

Referring to FIG. 1, a typical prior art vane-type cam phaser 10 includes a pulley or sprocket 12 for engaging a timing chain or belt (not shown) operated by an engine crankshaft (not shown). The upper surface 14 of pulley/sprocket 12 forms a first wall of a plurality of hydraulic chambers in the assembled phaser. A stator 16 is disposed against surface 14 and is sealed thereto by a first seal ring 18. As discussed below, stator 16 is rotationally immobilized with respect to pulley/sprocket 12. Stator 16 is provided with a plurality of inwardly-extending lobes 20 circumferentially spaced apart for receiving a rotor 21 including outwardly extending vanes 22 which extend into the spaces between lobes 20. Hydraulic advance and retard chambers (not visible in exploded drawing) are thus formed between lobes 20 and vanes 22. A thrust washer 24 is concentrically disposed against rotor 21, and cover plate 26 seals against stator 16 via a second seal ring 28. Bolts 30 extend through bores 32 in stator 16 and are received in threaded bores 34 in pulley/sprocket 12, immobilizing the stator with respect to the pulley/sprocket. In installation to an engine camshaft, phaser 10 is secured via a central bolt (not shown) through thrust washer 24 which is covered by cover plug 36 which is threaded into bore 38 in cover plate 26.

A locking bolt mechanism 40 comprises a hollow locking pin 42 having an annular shoulder 43, return spring 44, and bushing 46. Spring 44 is disposed inside pin 42, and bushing, pin, and spring are received in a longitudinal bore 48 formed in an oversize vane 22' of rotor 21, an end of pin 42 being extendable by spring 44 from the underside of the vane. A pin guide 47 is disposed in a well 49 formed in pulley/sprocket 12 for receiving an end portion of pin 42 when extended from bore 48 to rotationally lock rotor 21 to pulley/sprocket 12 and, hence, stator 16. The axial stroke of pin 42 is limited by interference of shoulder 43 with bushing 46. A shallow channel 51 formed in pulley/sprocket 12 extends from below guide 47 and intersects surface 14' in a region of that surface which forms a wall of a selected advance chamber in the assembled phaser. Thus, when oil is supplied to advance the rotor with respect to the stator, oil also flows through channel 51 to bring pressure to bear on the end surface (axial face) 53 of pin 42, causing the pin to be forced from guide 47 and thereby unlocking the rotor from the stator. As noted above, in some instances it has been found that pressure build-up in the advance chamber, urging the rotor rotationally, causes pin 42 to become bound in guide 47 and to not be retracted in response to oil pressure supplied through channel 51, as desired.

Figure 2:
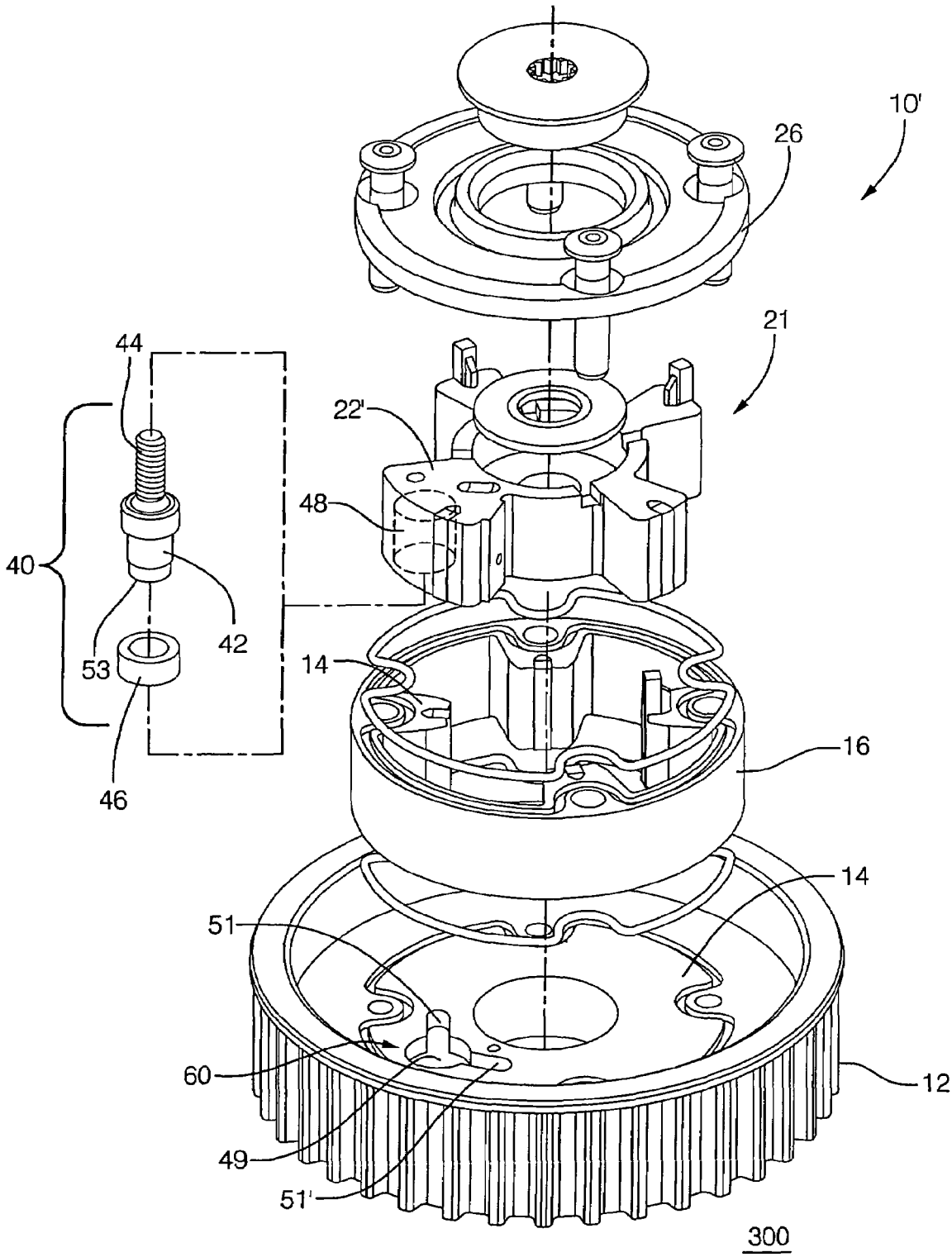
FIG. 2 is an exploded isometric view of a vane-type camshaft phaser showing a first embodiment of a locking pin mechanism in accordance with the invention.
Figure 3:
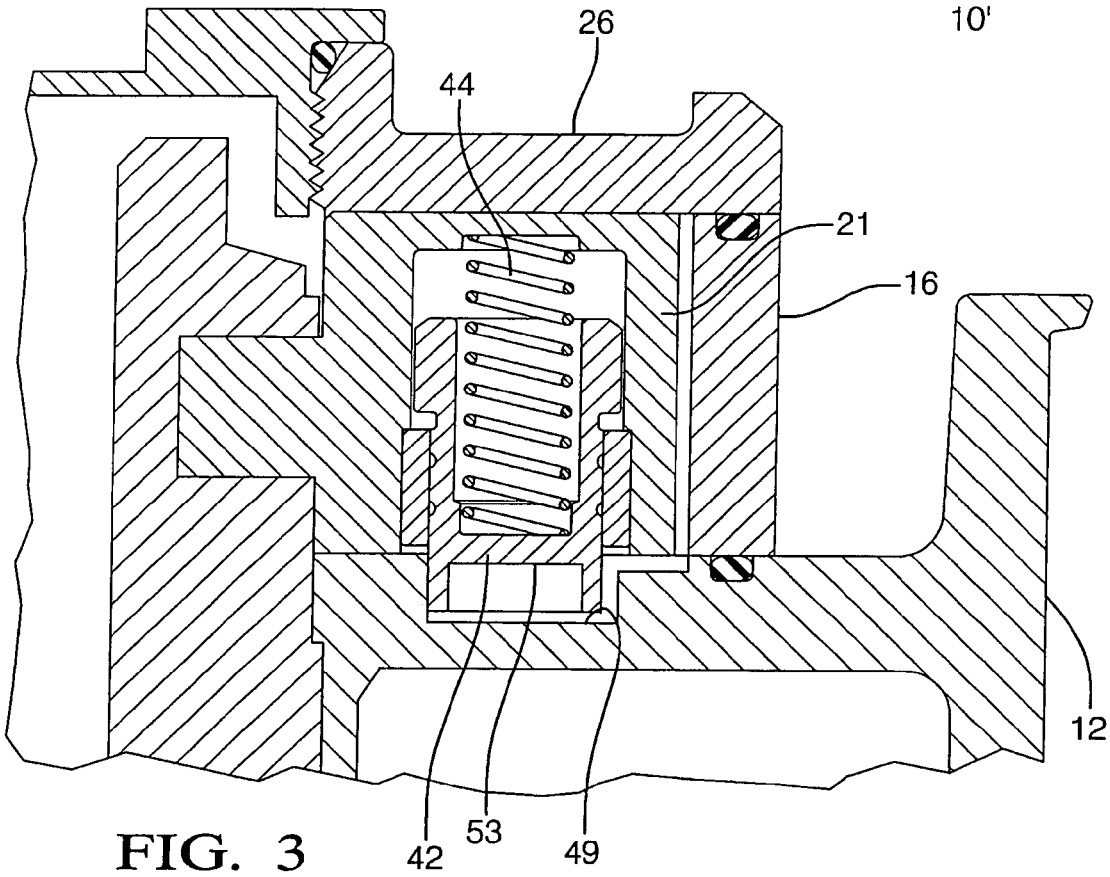
FIG. 3 is a detailed cross-sectional elevational view of the locking pin mechanism shown in FIG. 2.

Referring to FIGS. 2 and 3, a first embodiment 60 of a locking pin mechanism for a camshaft phaser 10' in accordance with the invention, for use with an internal combustion engine 300, includes a first unlocking channel 51 formed in pulley/sprocket surface 14 substantially in accordance with the prior art, extending in the assembled phaser from an advance chamber into well 49 (guide 47 is omitted from the pulley/sprocket for clarity). In novel addition, a second unlocking channel 51' is provided in surface 14 extending from well 49 into conjunction with an adjacent retard chamber in phaser 10'. Thus, pin 42 is subjected to pressurized oil on end surface 53 thereof from both phaser-advance and phaser-retard oil supplies. When either or both supplies exceed a predetermined pressure level, spring 44 is overcome, and pin 42 is retracted and remains retracted as long as this pressure level is maintained. The relative cross-sectional areas and lengths of channels 51,51' may be identical or may differ if desired to further regulate the respective pressurized oil flows against end surface 53.

Figure 4:
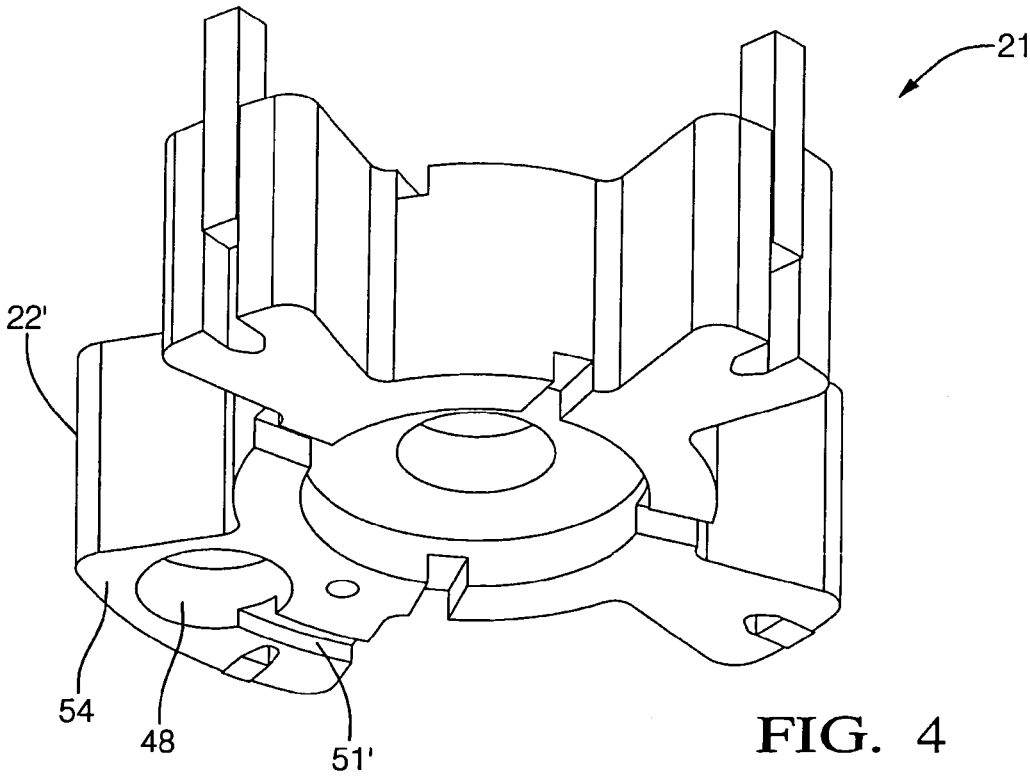
FIG. 4 is an isometric view from the underside of a rotor, shown a pin-actuating oil channel formed in the rotor itself.
Figure 5:
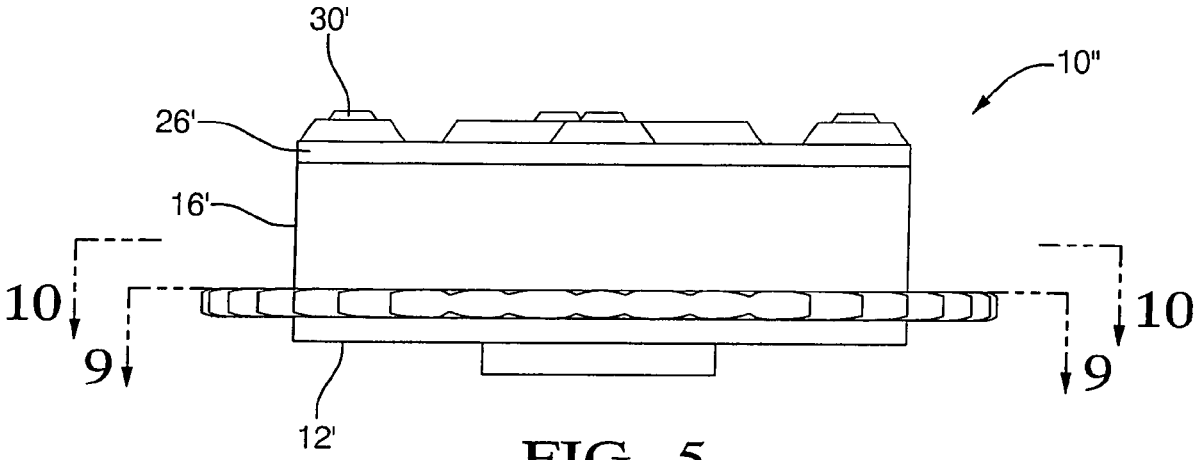
FIG. 5 is an elevational view of a vane-type camshaft phaser incorporating a second embodiment of a locking pin mechanism in accordance with the invention, and showing the locations of cross-sectional views shown in FIGS. 9 and 10.
Figure 6:
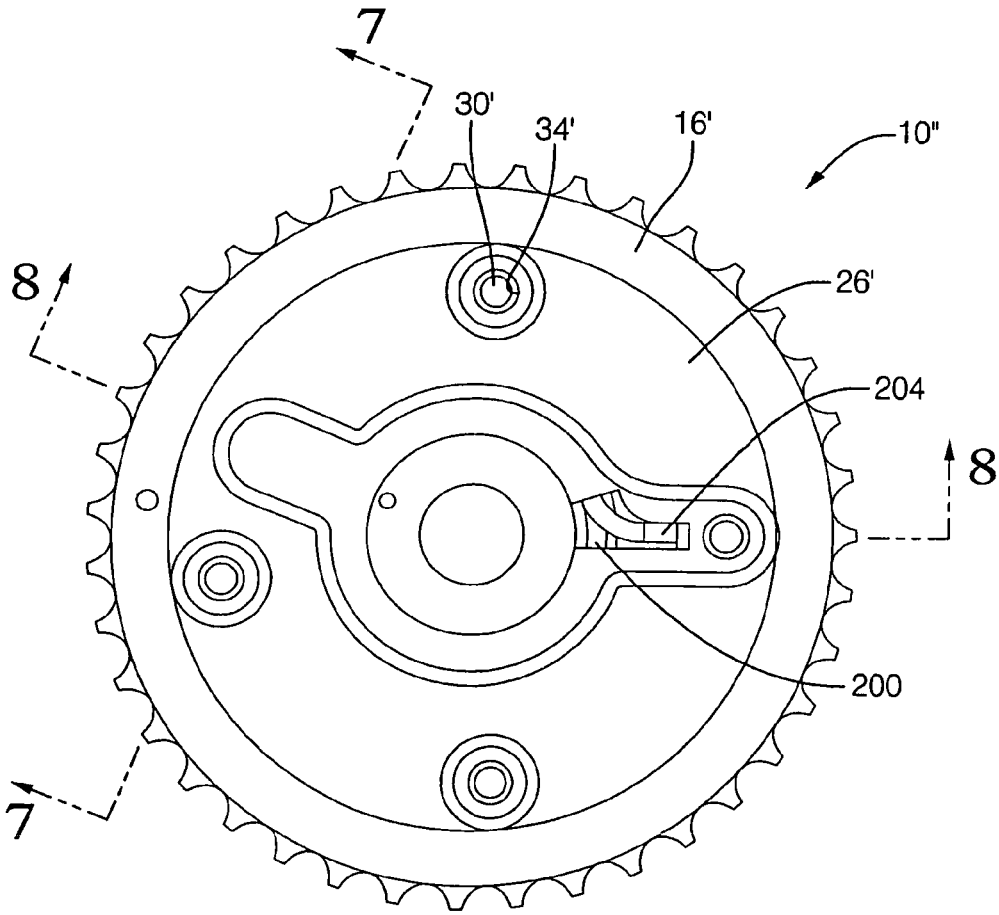
FIG. 6 is a plan view of the phaser shown in FIG. 5, showing the locations of cross-sectional views shown in FIGS. 7 and 8.
Figure 7:
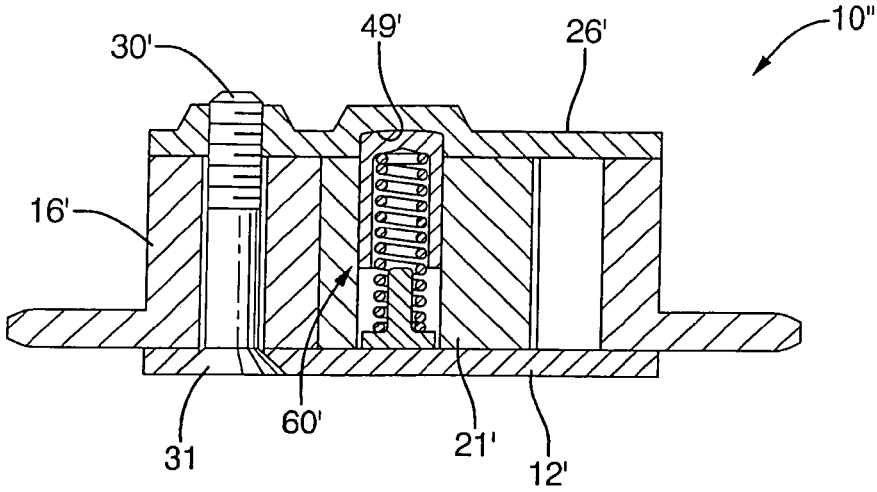
FIG. 7 is a cross-sectional view taken along line 7-7 in FIG. 6.

Referring to FIG. 4, in an alternative embodiment of phaser 10', second channel 51' may be formed in surface 54 of rotor 21 rather than in surface 14 of the pulley/sprocket, to equal effect.

Referring to FIGS. 5 through 11, a second embodiment 10" of a camshaft phaser in accordance with the invention is similar in components, assembly, and function to first embodiment 10'. The same component numbers are used or primed as appropriate.

Figure 11:
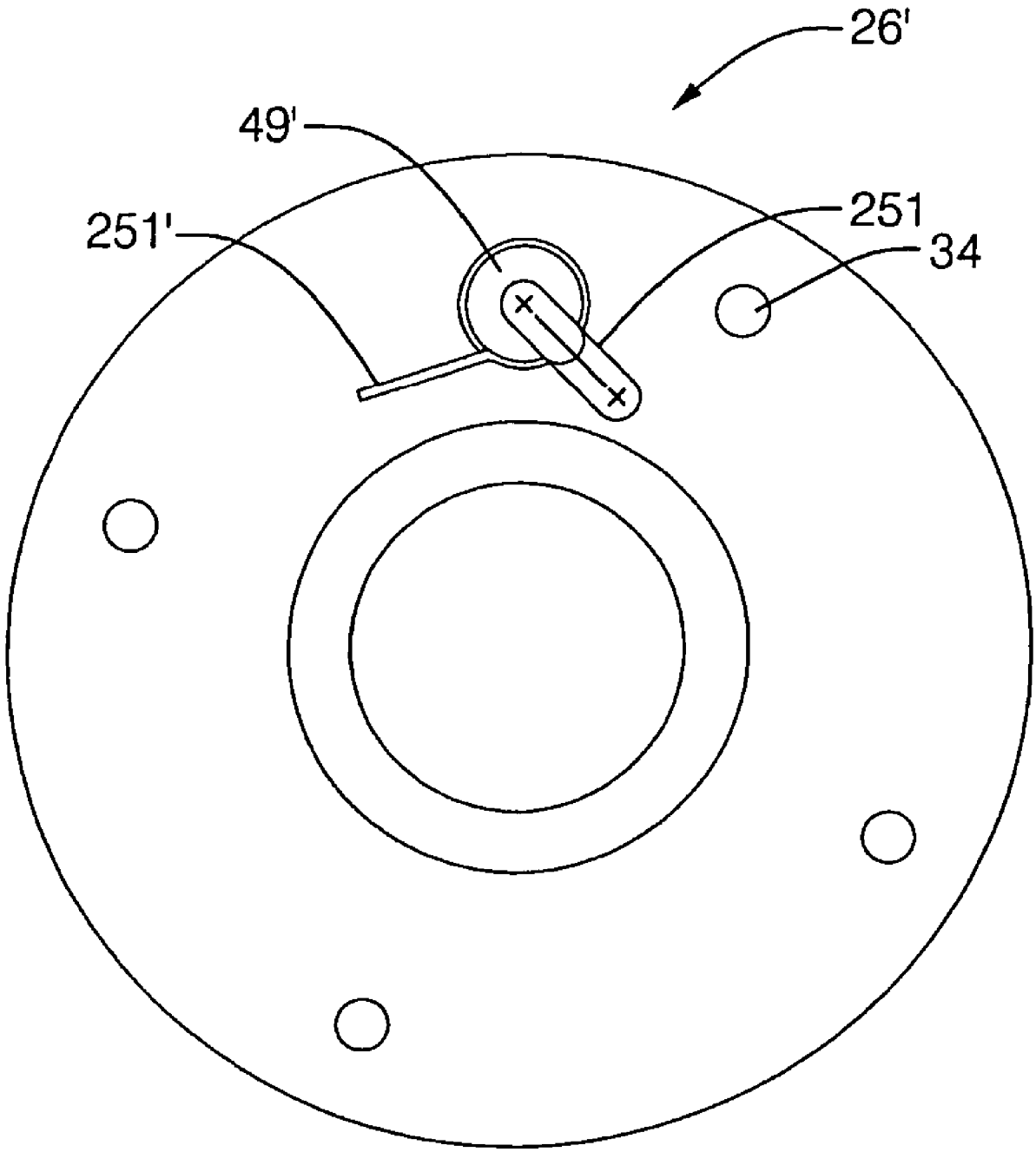
FIG. 11 is a plan view of the underside of a front cover plate having oil supply channels and a pin-locking well in accordance with the invention.

However, the locking pin mechanism 60' is inverted such that well 49' is formed in front cover plate 26' as are first and second channels 251,251', as shown in FIG. 11. Further, the orientation of bolts 30' is also inverted such that the heads 31 of the bolts are received in countersinks in rear cover 12', and the threaded ends are received in threaded bores 34' in front cover plate 26'.

In detail, in second embodiment 10", the sprocket is formed integrally with stator 16' rather than with the rear cover 12' as in the prior art. This arrangement enhances manufacturability and reduces cost. A coiled bias spring 200 is disposed in a central well 202 formed in rotor 21' and is anchored to cover 26' by tang 204 for urging rotor 21' to a predetermined rest position, for example, fully retarded at engine shutdown. A bore 48' through rotor vane 22" receives pin assembly 60' comprising a spring guide 206 and a pin 42' having a counterbore for receiving a return spring 44. Pin 42' at locking is urged by spring 44 into a well 49' formed in front cover 26'. Advance and retard channels 251,251' are also formed in front cover 26' and extend laterally from well 49' in identical fashion to channels 51,51' described hereinabove. Alternatively, channels 251,251' may be formed in the mating face of rotor 21'. Channel 251 preferably enters well 49' off-center. Also, the cross-sectional depth of channel 251' preferably is smaller than the cross-sectional depth of channel 251. However, it should be noted that the cross sectional depths of channels 251,251' may be varied independently to any relative size to provide the desired unlocking forces to pin end surface 53.

It should be understood that "advance" and "retard" as used herein throughout refer only to relative direction of the rotor within the stator. As shown in FIGS. 5-11, the rotor is locked at an extreme position of rotor rotation, which commonly in the prior art is fully retarded, but if so desired the rotor could be locked at fully advanced, in which case the meaning of advance and retard in the present discussions should simply be reversed.

Figure 8:
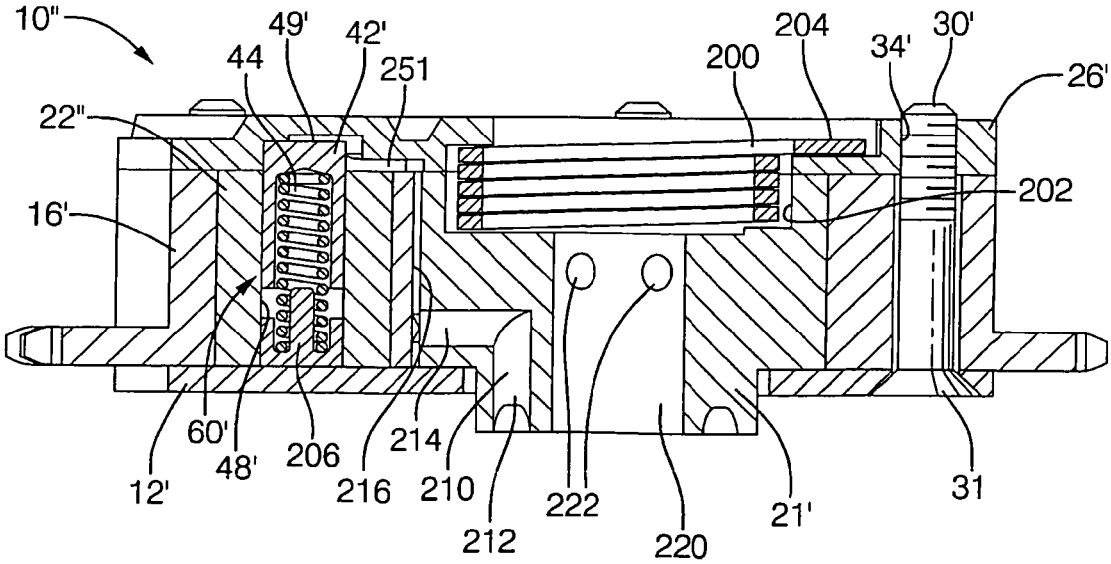
FIG. 8 is a cross-sectional view taken along line 8-8 in FIG. 6.
Figure 9:
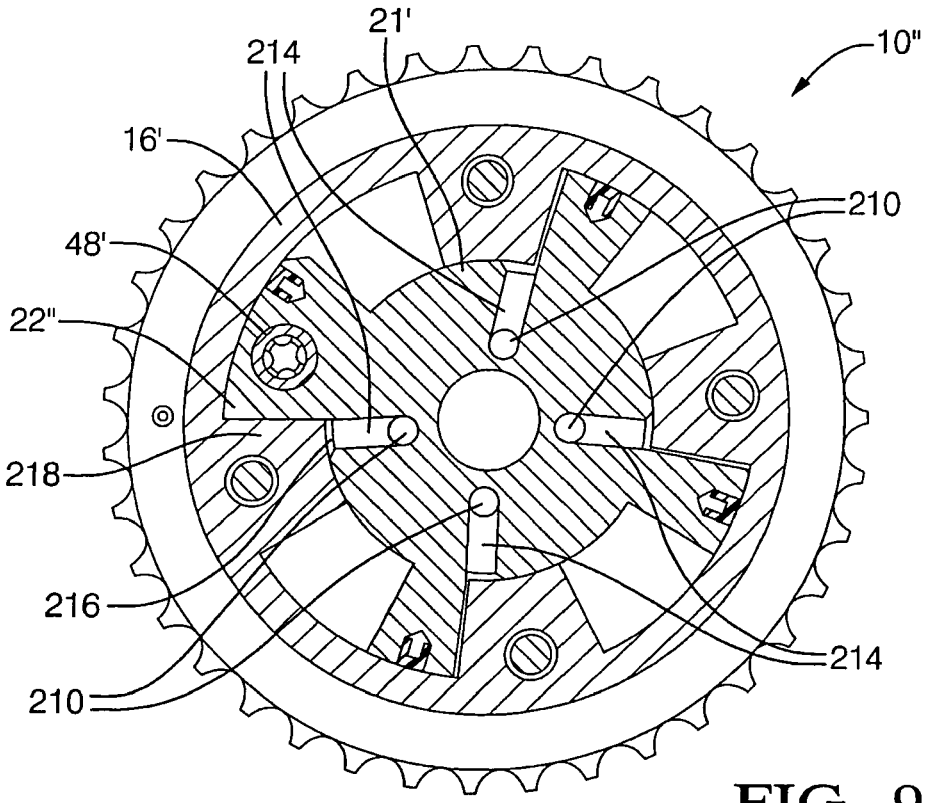
FIG. 9 is a cross-sectional view taken along line 9-9 in FIG. 5.
Figure 10:
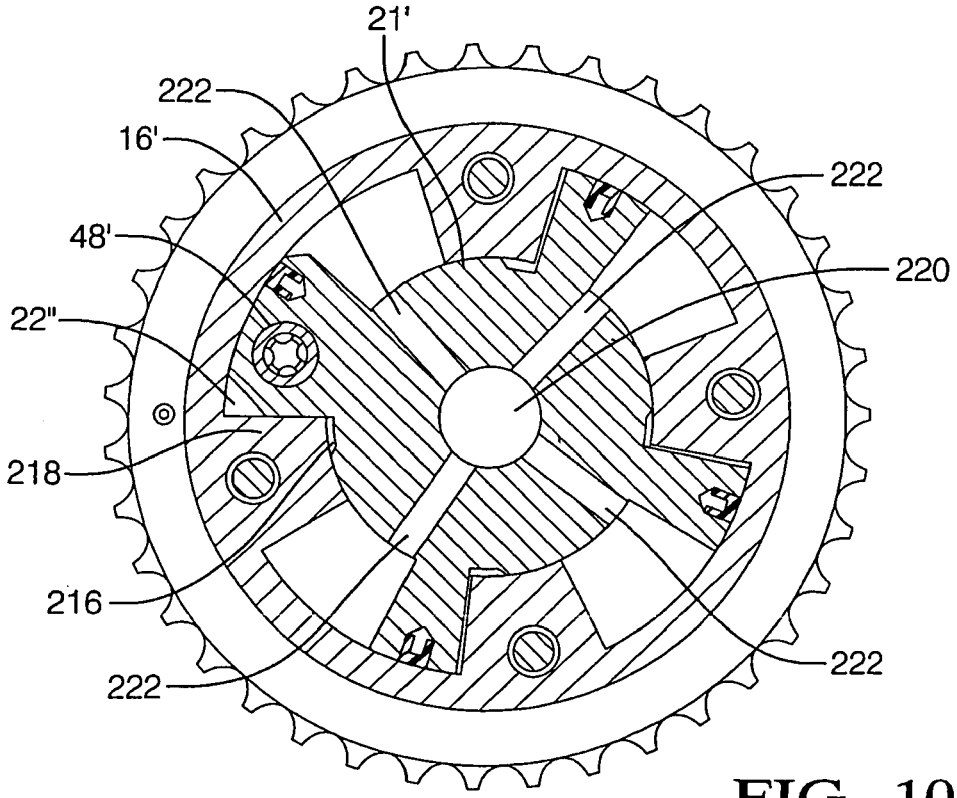
FIG. 10 is a cross-sectional view taken along line 10-10 in FIG. 5.

Referring to FIGS. 8 through 10, the advance oil supply flowpath to the pin locking well 49' is shown. Oil for causing the phaser to advance is supplied to risers 210 from an annular distributor 212 and thence radially of the rotor via passages 214. An axial channel 216 is formed in the rotor at the root of oversize vane 22" such that oil is supplied axially to channel 251 and thence to well 49'. Channel 216 assures supply of oil to unlock pin assembly 40' even when the rotor is locked in full retard such that the advance chamber to be formed between vane 22' and stator lobe 218 has zero volume, as shown in FIGS. 9 and 10.

Oil for causing the phaser to retard is supplied conventionally via central bore 220 and radial passages 222.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A locking pin mechanism for variably locking together a rotor and a stator in a vane-type camshaft phaser having a rear cover plate and a front cover plate secured to the stator and enclosing the rotor within the stator, the phaser including passages for supplying phase-advance oil and phase-retard oil to respective advance and retard chambers formed between the rotor and stator, the locking pin mechanism comprising:

a) a locking pin disposed in a bore in said rotor;

b) a well formed in one of said rear cover plate or said front cover plate for receiving a portion of said locking pin in a locked mode, said well including a bottom wall;

c) a first passage connecting said well to said phase-advance oil; and d) a second passage connecting said well to said phase-retard oil, wherein said locking pin is in contact with said bottom wall of said well in the locked mode.

2. A mechanism in accordance with claim 1, further comprising a return spring disposed in said bore for urging said pin into said well.

3. A mechanism in accordance with claim 1, further comprising a guide disposed in said bore.

4. A mechanism in accordance with claim 1, wherein said first passage is formed in one of said front cover plate or said rotor.

5. A mechanism in accordance with claim 1, wherein said second passage is formed in one of said front cover plate or said rotor.

6. A mechanism in accordance with claim 1, wherein the cross-sectional area of said second passage is smaller than the cross-sectional area of said first passage.

7. A mechanism in accordance with claim 1, wherein said locking pin is straight-sided.

8. A locking pin mechanism for variably locking together a rotor and a stator in a vane-type camshaft phaser having a rear cover plate and a front cover plate secured to the stator and enclosing the rotor within the stator, the phaser including passages for supplying phase-advance oil and phase-retard oil to respective advance and retard chambers formed between the rotor and stator, the locking pin mechanism comprising:

a) a locking pin disposed in a bore in said rotor, said locking pin includes an end surface;

b) a well formed in one of said rear cover plate or said front cover plate for receiving a portion of said locking pin in a locked mode;

c) a first passage connecting said well to said phase-advance oil; and d) a second passage connecting said well to said phase-retard oil, wherein said end surface of said locking pin is in contact with said well in the locked mode.

9. A mechanism in accordance with claim 8, wherein said phase-advance oil and said phase-retard oil is in fluid communication with said end surface of said locking pin in the locked mode.

10. A method for variably locking together a rotor and a stator in a vane-type camshaft phaser having a rear cover plate and a front cover plate secured to the stator and enclosing the rotor within the stator, wherein advance and retard chambers are formed between the rotor and stator, the method comprising:

providing a locking pin disposed in a bore in said rotor;

providing a well in one of said rear cover plate or said front cover plate, said well including a bottom wall;

positioning a portion of said locking pin in said well in a locking mode so that the rotor is coupled with the stator, wherein said locking pin is in contact with said bottom wall of said well;

providing a supply of phase-advance oil and phase-retard oil;

placing said phase-advance oil in communication with said well and said locking pin in the locked mode; and placing said phase-retard oil in communication with said well and said locking pin in the locked mode thereby allowing the locking pin to be moved to an unlocked mode when a predetermined oil pressure is exceeded by one of said phase-advance oil or said phase-retard oil.

11. A method in accordance with claim 10, further comprising increasing the pressure of at least one of said supply of phase-advance or phase-retard oil to move said locking pin to the unlocked mode.

12. A method in accordance with claim 10, further comprising:

providing a first passage extending from said well to allow said phase-advance oil to flow into said well; and providing a second passage extending from said well to allow said phase-retard oil to flow into said well.

13. A method in accordance with claim 10, wherein said locking pin is straight-sided.

14. A method for variably locking together a rotor and a stator in a vane-type camshaft phaser having a rear cover plate and a front cover plate secured to the stator and enclosing the rotor within the stator, wherein advance and retard chambers are formed between the rotor and stator, the method comprising:

providing a locking pin disposed in a bore in said rotor, said locking pin includes an end surface;

providing a well in one of said rear cover plate or said front cover plate;

positioning a portion of said locking pin in said well in a locking mode so that the rotor is coupled with the stator, wherein said end surface of said locking pin is in contact with said well in the locking mode;

providing a supply of phase-advance oil and phase-retard oil;

placing said phase-advance oil in communication with said well and said locking pin in the locked mode; and placing said phase-retard oil in communication with said well and said locking pin in the locked mode thereby allowing the locking pin to be moved to an unlocked mode when a predetermined oil pressure is exceeded by one of said phase-advance oil or said phase-retard oil.

15. A method in accordance with claim 14, wherein said phase-advance oil in communication with said well and said end surface of said locking pin in the locked mode.

16. A method in accordance with claim 15, wherein said phase-retard oil in communication with said well and said end surface of said locking pin in the locked mode.

* * * * *